US011328677B2

(12) United States Patent
Yang et al.

(10) Patent No.: US 11,328,677 B2
(45) Date of Patent: May 10, 2022

(54) METHOD AND DEVICE FOR DRIVING PIXEL CIRCUIT, AND STORAGE MEDIUM

(71) Applicant: BOE Technology Group Co., Ltd., Beijing (CN)

(72) Inventors: Shengji Yang, Beijing (CN); Xue Dong, Beijing (CN); Xiaochuan Chen, Beijing (CN); Hui Wang, Beijing (CN); Pengcheng Lu, Beijing (CN); Fang Yu, Beijing (CN); Wei Liu, Beijing (CN)

(73) Assignee: BOE TECHNOLOGY GROUP CO., LTD., Beijing (CN)

( * ) Notice: Subject to any disclaimer, the term of this patent is extended or adjusted under 35 U.S.C. 154(b) by 57 days.

(21) Appl. No.: 16/768,124

(22) PCT Filed: May 22, 2019

(86) PCT No.: PCT/CN2019/088009

§ 371 (c)(1),
(2) Date: May 29, 2020

(87) PCT Pub. No.: WO2019/223730

PCT Pub. Date: Nov. 28, 2019

(65) Prior Publication Data

US 2020/0312250 A1 Oct. 1, 2020

(30) Foreign Application Priority Data

May 22, 2018 (CN) ..... 201810495058.6

(51) Int. Cl.
*G09G 3/32* (2016.01)
*G09G 3/3291* (2016.01)
*G09G 3/3233* (2016.01)

(52) U.S. Cl.
CPC ..... *G09G 3/3291* (2013.01); *G09G 3/3233* (2013.01); *G09G 2300/0842* (2013.01)

(58) Field of Classification Search
None
See application file for complete search history.

(56) References Cited

U.S. PATENT DOCUMENTS

2013/0002641 A1 1/2013 Kim et al.
2013/0307840 A1 11/2013 Lee et al.
(Continued)

FOREIGN PATENT DOCUMENTS

CN 102855863 A 1/2013
CN 104900199 A 9/2015
(Continued)

OTHER PUBLICATIONS

International search report of PCT application No. PCT/CN2019/088009 dated Aug. 21, 2019.
(Continued)

*Primary Examiner* — Parul H Gupta
(74) *Attorney, Agent, or Firm* — Fay Sharpe LLP

(57) ABSTRACT

A method and a device for driving a pixel circuit, and a storage medium are provided. When a current data voltage of a pixel circuit is within a first voltage range and a target data voltage of the pixel circuit is within a second voltage range, the driving method comprises: refreshing a data voltage stored in the pixel circuit with a boundary value between the first voltage range and the second voltage range using a gate signal reference voltage corresponding to the first voltage range; and refreshing the data voltage stored in the pixel circuit with the target data voltage using a gate signal reference voltage corresponding to the second voltage range.

19 Claims, 3 Drawing Sheets

(56) References Cited

U.S. PATENT DOCUMENTS

| | | | | |
|---|---|---|---|---|
| 2015/0256167 | A1 | 9/2015 | Lu | |
| 2017/0084230 | A1 | 3/2017 | Lien et al. | |
| 2017/0287414 | A1* | 10/2017 | Uriostigue | G09G 3/2003 |
| 2019/0251905 | A1 | 8/2019 | Yang et al. | |

FOREIGN PATENT DOCUMENTS

| | | | |
|---|---|---|---|
| CN | 106533410 | A | 3/2017 |
| CN | 106548738 | A | 3/2017 |
| CN | 107424570 | A | 12/2017 |
| CN | 108682393 | A | 10/2018 |

OTHER PUBLICATIONS

First office action of Chinese application No. 201810495058.6 dated Jul. 30, 2019.
Second office action of Chinese application No. 201810495058.6 dated Mar. 10, 2020.

* cited by examiner

METHOD AND DEVICE FOR DRIVING PIXEL CIRCUIT, AND STORAGE MEDIUM

This application is a 371 of PCT Application No. PCT/CN2019/088009, filed May 22, 2019, which claims priority to Chinese Patent Application No. 201810495058.6, filed on May 22, 2018 and entitled "DRIVING METHOD AND DEVICE FOR PIXEL CIRCUIT", the entire contents of which are incorporated herein by reference.

TECHNICAL FIELD

The present disclosure relates to the field of display, and more particular, to a method and device of driving a pixel circuit, and a storage medium.

BACKGROUND

An organic light-emitting diode (OLED) display is a display product mainly made of OLEDs, and become one of the mainstream display products at present owing to the advantages of high brightness, rich colors, low data voltage, fast response and low power consumption. An OLED is an all-solid-state device with excellent vibration resistance and a wide operating temperature range, and thus, is suitable for military and special applications. The OLED is also a self-luminous device that does not require a backlight source, has a wide viewing angle range and is of thin, and thus, is conducive to reduce the size of a system and especially suitable for a near-eye display (NED) system.

SUMMARY

The present disclosure provides a method and device of driving a pixel circuit, and a storage medium.

Embodiments of the present disclosure provide a method of driving a pixel circuit, wherein the pixel circuit is configured to refresh a stored data voltage under control of a gate signal; and when a current data voltage of the pixel circuit is within a first voltage range and a target data voltage of the pixel circuit is within a second voltage range. The method comprises:

refreshing the data voltage stored in the pixel circuit with a demarcation value between the first voltage range and the second voltage range through a first gate signal reference voltage corresponding to the first voltage range; and refreshing the data voltage stored in the pixel circuit with the target data voltage through a second gate signal reference voltage corresponding to the second voltage range, wherein the target data voltage and the current data voltage are data voltages after and before the refreshing in a refreshing process respectively; the first voltage range and the second voltage range respectively take the demarcation value as one of a maximum endpoint and a minimum endpoint: the first gate signal reference voltage is lower than the second gate signal reference voltage when the target data voltage is higher than the current data voltage; the first gate signal reference voltage is higher than the second gate signal reference voltage when the target data voltage is lower than the current data voltage; and the first gate signal reference voltage and the second gate signal reference voltage are measurement criteria of a level status of the gate signal.

In a possible implementation, the pixel circuit receives the gate signal by a gate line and receives the data voltage by a data line;

refreshing the data voltage stored in the pixel circuit with the demarcation value between the first voltage range and the second voltage range through the first gate signal reference voltage corresponding to the first voltage range comprises:

providing the gate line with a gate signal based on the first gate signal reference voltage, and providing the data line with a voltage of which a value is the demarcation value, such that the data voltage stored in the pixel circuit is refreshed with the demarcation value; and correspondingly, refreshing the data voltage stored in the pixel circuit with the target data voltage through the second gate signal reference voltage corresponding to the second voltage range comprises:

providing the gate line with a gate signal based on the second gate signal reference voltage, and providing the data line with the target data voltage, such that the data voltage stored in the pixel circuit is refreshed with the target data voltage.

Optionally, a difference between a maximum endpoint and a minimum endpoint of the first voltage range equals that between a maximum endpoint and a minimum endpoint of the second voltage range, and an absolute value of a difference between the first gate signal reference voltage and the second gate signal reference voltage equals the difference between the maximum endpoint and the minimum endpoint of the first voltage range.

In a possible implementation, the gate signal comprises a light-emitting control signal and a gate driving signal;

the pixel circuit comprises a data signal end and is configured to, when the received gate driving signal is at an effective level, refresh the stored data voltage based on a voltage at the data signal end, and the pixel circuit further comprises a light-emitting power end and a current output end and is further configured to, when the received light-emitting control signal is at an effective level, output light-emitting current to the current output end based on the stored data voltage under power supply by the light-emitting power end, and the value of the light-emitting current is in a positive correlation with a value of the data voltage.

In a possible implementation, the pixel circuit comprises:

a switching control sub-circuit configured to conduct an output path of the light-emitting current when the received light-emitting control signal is at an effective level;

a driving sub-circuit configured to adjust the value of the light-emitting current based on a voltage at a control end, such that the value of the light-emitting current is in a positive correlation with the value of the voltage at the control end;

a storage sub-circuit configured to store the data voltage and to provide the stored data voltage to the control end of the driving sub-circuit; and a data writing sub-circuit configured to, when the received gate driving signal is at an effective level, refresh the data voltage stored in the storage sub-circuit, based on the voltage at the data signal end.

In a possible implementation, the gate driving signal comprises a first gate driving signal and a second gate driving signal, and the data writing sub-circuit comprises a first N-type transistor and a first P-type transistor;

a gate of the first N-type transistor is connected to a signal line that provides the first gate driving signal, and a source and a drain of the first N-type transistor are respectively connected to one of the data signal end and the storage sub-circuit; and a gate of the first P-type transistor is connected to a signal line that provides the second gate driving signal, and a source and a drain of the first P-type transistor are respectively connected to one of the data signal end and the storage sub-circuit.

In a possible implementation, the storage sub-circuit comprises a first capacitor, wherein a first end of the first capacitor is connected to an output end of the data writing sub-circuit and a second end of the first capacitor is connected to a common voltage line;

the switching control sub-circuit comprises a first transistor, wherein a gate of the first transistor is connected to a signal line that provides the light-emitting control signal and a first electrode of the first transistor is connected to the light-emitting power end; and the driving sub-circuit comprises a driving transistor, wherein a gate of the driving transistor is connected to the first end of the first capacitor, a first electrode of the driving transistor is connected to a second electrode of the first transistor and a second electrode of the driving transistor is connected to the current output end.

In a possible implementation, the pixel circuit further comprises an initializing sub-circuit, and the initializing sub-circuit is configured to set a voltage at a current output end as an initializing voltage when a received initializing signal is at an effective level.

In a possible implementation, the initializing sub-circuit comprises a second transistor, wherein a gate of the second transistor is connected to a signal line that provides the initializing signal and a first electrode of the second transistor and a second electrode of the second transistor are respectively connected to one of the current output end and a common voltage line.

Embodiments of the present disclosure further provide a device of driving a pixel circuit, wherein the pixel circuit is configured to refresh a stored data voltage under control of a gate signal. The device comprises:

a first refreshing module configured to, when a current data voltage of the pixel circuit is within a first voltage range and a target data voltage of the pixel circuit is within a second voltage range, refresh the data voltage stored in the pixel circuit with a demarcation value between the first voltage range and the second voltage range through a first gate signal reference voltage corresponding to the first voltage range; and a second refreshing module configured to, after the data voltage stored in the pixel circuit is refreshed with the demarcation value, refresh the data voltage stored in the pixel circuit to the target data voltage through a second gate signal reference voltage corresponding to the second voltage range, wherein the target data voltage and the current data voltage are data voltages after and before the refreshing in a refreshing process respectively; the first voltage range and the second voltage range respectively take the demarcation value as one of a maximum endpoint and a minimum endpoint; the first gate signal reference voltage is lower than the second gate signal reference voltage when the target data voltage is higher than the current data voltage; the first gate signal reference voltage is higher than the second gate signal reference voltage when the target data voltage is lower than the current data voltage; and the first gate signal reference voltage and the second gate signal reference voltage are measurement criteria of a level status of the gate signal.

In a possible implementation, the pixel circuit receives the gate signal by a gate line and receives the data voltage by a data line;

the first refreshing module is configured to provide the gate line with a gate signal based on the first gate signal reference voltage, and to provide the data line with a voltage of which a value is the demarcation value, such that the data voltage stored in the pixel circuit is refreshed with the demarcation value; and the second refreshing module is configured to provide the gate line with a gate signal based on the second gate signal reference voltage, and to provide the data line with the target data voltage, such that the data voltage stored in the pixel circuit is refreshed with the target data voltage Optionally, a difference between a maximum endpoint and a minimum endpoint of the first voltage range equals that between a maximum endpoint and a minimum endpoint of the second voltage range, and an absolute value of a difference between the first gate signal reference voltage and the second gate signal reference voltage equals the difference between the maximum endpoint and the minimum endpoint of the first voltage range.

In a possible implementation, the gate signal comprises a light-emitting control signal and a gate driving signal;

the pixel circuit comprises a data signal end and is configured to, when the received gate driving signal is at an effective level, refresh the stored data voltage with a voltage at the data signal end; and the pixel circuit further comprises a light-emitting power end and a current output end and is further configured to, when the received light-emitting control signal is at an effective level, output light-emitting current to the current output end based on the stored data voltage under power supply by the light-emitting power end, and the value of the light-emitting current is in a positive correlation with a value of the data voltage.

In a possible implementation, the pixel circuit comprises:

a switching control sub-circuit configured to conduct an output path of the light-emitting current when the received light-emitting control signal is at an effective level;

a driving sub-circuit configured to adjust the value of the light-emitting current based on a voltage at a control end, such that the value of the light-emitting current is in a positive correlation with the value of the voltage at the control end;

a storage sub-circuit configured to store the data voltage and to provide the stored data voltage for the control end of the driving sub-circuit; and a data writing sub-circuit configured to, when the received gate driving signal is at an effective level, refresh the data voltage stored in the storage sub-circuit based on the voltage at the data signal end.

In a possible implementation, the gate driving signal comprises a first gate driving signal and a second gate driving signal, and the data writing sub-circuit comprises a first N-type transistor and a first P-type transistor;

a gate of the first N-type transistor is connected to a signal line that provides the first gate driving signal, and a first electrode of the first N-type transistor and a second electrode of the first N-type transistor are respectively connected to one of the data signal end and the storage sub-circuit; and a gate of the first P-type transistor is connected to a signal line that provides the second gate driving signal, and a first electrode of the first P-type transistor and a second electrode of the first P-type transistor are respectively connected to one of the data signal end and the storage sub-circuit.

In a possible implementation, the storage sub-circuit comprises a first capacitor wherein a first end of the first capacitor is connected to an output end of the data writing sub-circuit and a second end of the first capacitor is connected to a common voltage line;

the switching control sub-circuit comprises a first transistor, wherein a gate is connected to a signal line that provides the light-emitting control signal and a first electrode is connected to the light-emitting power end; and the driving sub-circuit comprises a driving transistor wherein a gate of the driving transistor is connected to the first end of the first capacitor, a first electrode of the driving transistor is connected to a second electrode of the first transistor and a second electrode of the first transistor is connected to the current output end.

In a possible implementation, the pixel circuit further comprises an initializing sub-circuit, and the initializing sub-circuit is configured to set a voltage at a current output end as an initializing voltage when a received initializing signal is at an effective level.

In a possible implementation, the initializing sub-circuit comprises a second transistor, wherein a gate of the second transistor is connected to a signal line that provides the initializing signal and a first electrode of the second transistor and a second electrode of the second transistor are respectively connected to one of the current output end and a common voltage line.

Embodiments of the present disclosure further provide a device of driving a pixel circuit, wherein the pixel circuit is configured to refresh a stored data voltage under control of a gate signal. The device comprises:

a processor; and a memory configured to store an instruction executable by the processor, wherein the processor is configured to:

when a current data voltage of the pixel circuit is within a first voltage range and a target data voltage of the pixel circuit is within a second voltage range, refresh the data voltage stored in the pixel circuit with a demarcation value between the first voltage range and the second voltage range through a first gate signal reference voltage corresponding to the first voltage range; and after the data voltage stored in the pixel circuit is refreshed with the demarcation value, refresh the data voltage stored in the pixel circuit with the target data voltage through a second gate signal reference voltage corresponding to the second voltage range, wherein the target data voltage and the current data voltage are data voltages after and before the refreshing in a refreshing process respectively; the first voltage range and the second voltage range respectively take the demarcation value as one of a maximum endpoint and a minimum endpoint; the first gate signal reference voltage is lower than the second gate signal reference voltage when the target data voltage is higher than the current data voltage; the first gate signal reference voltage is higher than the second gate signal reference voltage when the target data voltage is lower than the current data voltage; and the first gate signal reference voltage and the second gate signal reference voltage are measurement criteria of a level status of the gate signal.

Embodiments of the present disclosure further provide a computer-readable storage medium, wherein when an instruction in the computer-readable storage medium is executed by a processor of a computer, the computer is caused to perform the method as described above.

DETAILED DESCRIPTION

To make the principles, technical solutions and advantages of the present disclosure clearer, the embodiments of the present disclosure will be described below in detail in conjunction with the accompanying drawings. It is obvious that the described embodiments are part rather than all of the embodiments of the present disclosure.

The term "first" or "second" or a similar term used in the present disclosure does not denote any order, quantity, or importance, but is merely used to distinguish different components. The term "comprising" or a similar term means that elements or items which appear before the term include the elements or items listed after the term and their equivalents, and do not exclude other elements or items. The term "connection" or "connected to" or a similar term is not limited to a physical or mechanical connection but may include an electrical connection that is direct or indirect.

However, for example, in some application scenarios of the NED system, dimensions and specs of a thin film transistor (TFT) in an OLED product are limited to some extent. For example, a voltage difference between any two electrodes of the TFT in some low-voltage manufacture procedures cannot exceed 6 V, which correspondingly limits differences between maximums and minimums of voltages at two ends of a light-emitting device. This manifested that a possible contrast has an upper limit, and as a result, high-contrast display cannot be achieved.

Here, the voltage difference between any two electrodes of the TFT in the low-voltage manufacturing process may be determined by a voltage withstanding degree of a driving portion of the OLED. For example, for a silicon-based OLED display device, driving circuit portions, such as a pixel circuit and a gate driving circuit, are all integrated on a wafer, and the voltage withstanding degree of the driving portion of the OLED is a voltage withstanding degree of the wafer.

Figure 1:
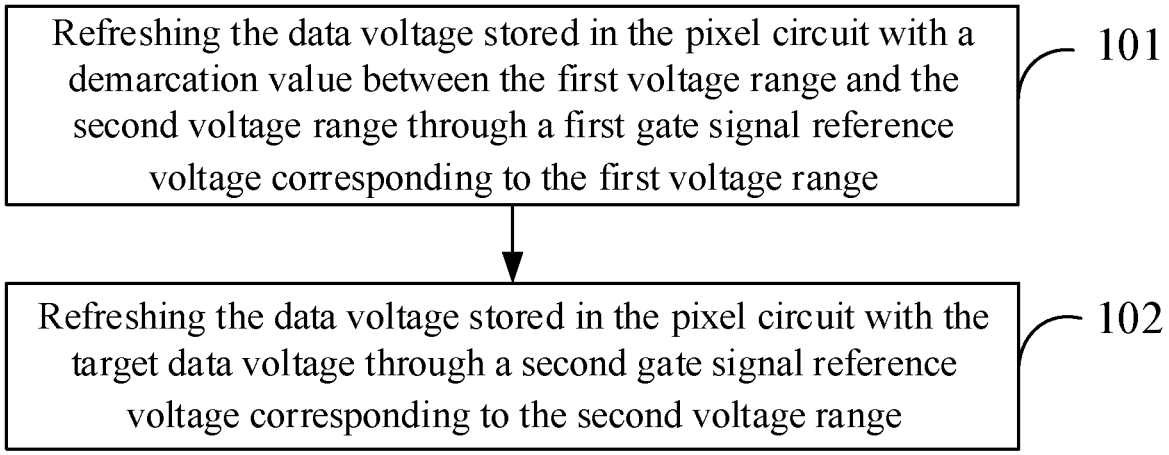
FIG. 1 is a schematic flow chart of a method of driving a pixel circuit in accordance with an embodiment of the present disclosure.

FIG. 1 is a schematic flow chart of a method of driving a pixel circuit in accordance with an embodiment of the present disclosure. The pixel circuit is configured to refresh a stored data voltage under the control of a gate signal. Referring to FIG. 1, when a current data voltage of the pixel circuit is within a first voltage range and a target data voltage of the pixel circuit is within a second voltage range, the method includes:

In step 101, a data voltage stored in the pixel circuit is refreshed with a demarcation value between the first voltage range and the second voltage range through a first gate signal reference voltage corresponding to the first voltage range.

In step 102, the data voltage stored in the pixel circuit is refreshed with the target data voltage through a second gate signal reference voltage corresponding to the second voltage range.

The target data voltage and the current data voltage are data voltages after and before the refreshing in a refreshing process respectively. The first voltage range and the second voltage range respectively take the demarcation value as a maximum endpoint and a minimum endpoint. The first gate signal reference voltage is lower than the second gate signal reference voltage if the target data voltage is higher than the current data voltage. The first gate signal reference voltage is higher than the second gate signal reference voltage if the target data voltage is lower than the current data voltage.

In the embodiment of the present disclosure, the first gate signal reference voltage and the second gate signal reference voltage are measurement criteria of a level status of the gate signal. That is, a level status of the gate signal takes the gate signal reference voltage as a reference zero. For example, if the gate signal reference voltage is 0 V, when the gate signal is 1 V, a voltage difference between the gate signal and the gate signal reference voltage is 1 V, and the gate signal is a low level, and when the gate voltage is 5 V, the voltage difference between the gate signal and the gate signal reference voltage is 5V, and the gate signal is a high level. For example, if the gate signal reference voltage is 4 V, when the gate signal is 5 V, a difference between the gate signal and the gate signal reference voltage is 1 V, the gate signal is a low level, and when the gate signal is 9 V, a difference between the gate signal and the gate signal reference voltage is 5 V, the gate signal is a high level.

It should be understood that the method of driving the pixel circuit may be performed by any device or a combination of devices capable of controlling the gate signal and the data voltage that are provided to the pixel circuit. For example, the device or the combination of devices includes, but not limited to, at least one of a timer controller (TCON), a graphics processing unit (GPU), a DC-DC converter and a power management IC (PMIC).

It should further be understood that the pixel circuit has the function of storing the data voltage and refreshing the stored data voltage under the control of the gate signal. The gate signal may be a single signal or a combination of a plurality of signals. The data voltage refers to a voltage parameter that determines a pixel display status in the pixel circuit. In one example, the data voltage stored in one of the pixel circuits in a certain display frame needs to be refreshed from a data voltage of 2 V to a data voltage of 3 V based on a display picture of a previous frame and a display picture of the current frame. At this time, the target data voltage of the pixel circuit is 3 V, and the current data voltage is 2 V. It can be understood that both of the target data voltage and the current data voltage may be determined by a picture that needs to be displayed, and may change over time.

In one example, the first voltage range is (1 V, 5 V], the second voltage range is (5 V, 9 V), and the demarcation value is 5 V. It can be seen that the demarcation value 5V is the maximum endpoint of the first voltage range and is the minimum endpoint of the second voltage range, and the values of the endpoints may or may not be included in the voltage ranges. For example, the above-mentioned first voltage range may further be set as (1 V, 5 V), [1 V, 5 V] or [1 V, 5 V) based on limiting conditions on the voltage ranges.

In one example, the limiting conditions on the voltage ranges of the data voltage are derived from limiting conditions on voltage difference between any two electrodes of the TFT in the low-voltage manufacture process. For example, under a limiting condition that the voltage difference between any two electrodes of the TFT may not exceed 6 V, by taking a drain voltage as a reference voltage of 0 V, the maximum and the minimum of the gate voltage of the TFT are 4 V and 1 V respectively (respectively corresponding to a high level and a low level). At this time, a voltage at a source may neither be higher than 6 V (a maximum voltage difference between the source and a drain is 6V), nor be lower than −2 V (the maximum voltage difference between the source and the gate is 6 V). If the TFT is configured to control writing of the data voltage, that is, when the TFT is conducted on, the voltage at the source is a data voltage provided to a driving transistor of the pixel circuit, and the value of the data voltage is limited within a range of −2 V to 6 V. Therefore, in the related art, data voltages corresponding to a brightest point and a darkest point of a display picture may only be within the range of −2 V to 6 V. Thus, a display contrast has a corresponding upper limit. That is, a high contrast may not be obtained.

However, in the embodiment of the present disclosure, corresponding gate signal reference voltages are utilized to write the data voltage within each voltage range in segments, such that writing of each voltage range may be performed within a tolerable range of the device. Thus, an allowable voltage writing range of the data voltage can be expanded.

In one example, the first gate signal reference voltage corresponding to the first voltage range (I V, 5 V) is 0 V, and the second gate signal reference voltage corresponding to the second voltage range (5 V, 9 V) is 4V. That is, changes of the data voltage within the first voltage range (1 V, 5 V) can meet the limiting conditions when the first gate signal reference voltage is 0 V, and changes of the data voltage within the first voltage range (5 V, 9 V) can meet the limiting conditions when the second gate signal reference voltage is 4 V. Based on this, if a variation range of the data voltage needs to cover the demarcation value 5V, for example, the current data voltage and the target data voltage are 2 V and 8 V respectively, refreshing of the data voltage may be performed for twice. First, the data voltage is refreshed from the current data voltage of 2 V to the demarcation value of 5 V when the first gate signal reference voltage is 0 V, and in this process, changes of the data voltage obviously meet the limiting conditions. Then, the gate signal reference voltage is adjusted to 4 V, namely, the second gate reference voltage, and the data voltage with the demarcation value of 5 V is refreshed with the target data voltage of 8 V, and in this process, changes of the data voltage obviously meet the limiting conditions as well. It thus can be seen that according to the method provided by the embodiment of the present disclosure, the data voltage that could only be changed within one voltage range may be changed within a plurality of voltage ranges. Similarly, a plurality of voltage ranges may be set based on tolerable ranges of the data voltage through different gate signal reference voltages, and segmented writing is performed in the above-mentioned way when the data voltage is switched between the different voltage ranges. Thus, a value range of the data voltage may be expanded.

It can be understood that for example, the values of the data voltages corresponding to the brightest point and the darkest point of the display picture may break the limitation of the range of −2 V to 6 V when the data voltage is expanded from the value range of −2 V to 6 V to a value range of −6 V to 10 V. Thus, the highest brightness of a single pixel in the display picture can be improved and/or the lowest brightness of the single pixel in the display picture can be reduced, which helps to increase the display contrast and/or the display brightness and to improve the display performance of the OLED product in a low-voltage manufacture procedure.

Exemplarily, a difference between a maximum endpoint and a minimum endpoint of the first voltage range equals to that between a maximum endpoint and a minimum endpoint of the second voltage range, and an absolute value of a difference between the first gate signal reference voltage and the second gate signal reference voltage equals to the difference between the maximum endpoint and the minimum endpoint of the first voltage range. When the maximum endpoint and the minimum endpoints of the first voltage range, the maximum endpoint and the minimum endpoint of the second voltage range, and the first gate signal reference voltage and the second gate signal reference voltage meet the above-mentioned relationship, it can be guaranteed that during segmented writing of the data voltage, a relationship between a voltage value corresponding to a high level of the gate signal (namely, the maximum voltage value of the gate signal) and two endpoint values of the voltage range, as well as that between a voltage value corresponding to a low level of the gate signal (namely, the minimum voltage value of the gate signal) and the two endpoint values of the voltage range, is kept unchanged. Thus, a limitation on the voltage difference between any two electrodes of the TFT may be always met in the low-voltage manufacture process.

For example, it is assumed that the first voltage range is (1 V, 5 V], the second voltage range is (5 V, 9 V), and the demarcation value is 5 V. The first gate reference voltage is 0 V, and correspondingly, a high-level voltage and a low-level voltage are respectively 1 V and 5 V. The second gate reference voltage is 4 V, and correspondingly, a high-level voltage and a low-level voltage are 5 V and 9 V respectively. At this time, the value difference between the two endpoints of the first voltage range is 4 V, the value difference between the two endpoints of the second voltage range is 4 V, and the value difference between the first gate reference voltage and the second gate reference voltage is also 4 V. If the data voltage in the first voltage range and the high-level and low-level voltages corresponding to the first gate reference voltage can meet the limiting conditions on the voltage difference in the low-voltage manufacture process, since the relationship between the data voltage in the second voltage range and the high-level and low-level voltages corresponding to the second reference voltage is consistent with that between the data voltage in the first voltage range and the high-level and low-level voltages corresponding to the first gate reference voltage, the data voltage in the second voltage range and the high-level and low-level voltages corresponding to the second gate reference voltage may also meet the limiting conditions on the voltage difference in the low-voltage manufacture process.

In the embodiment of the present disclosure, the gate signal means a signal provided by a driving circuit to the gate of the TFT in the pixel circuit. The method according to the embodiments of the present disclosure will be described below by taking the pixel circuit illustrated in FIG. 2 as an example.

Figure 2:
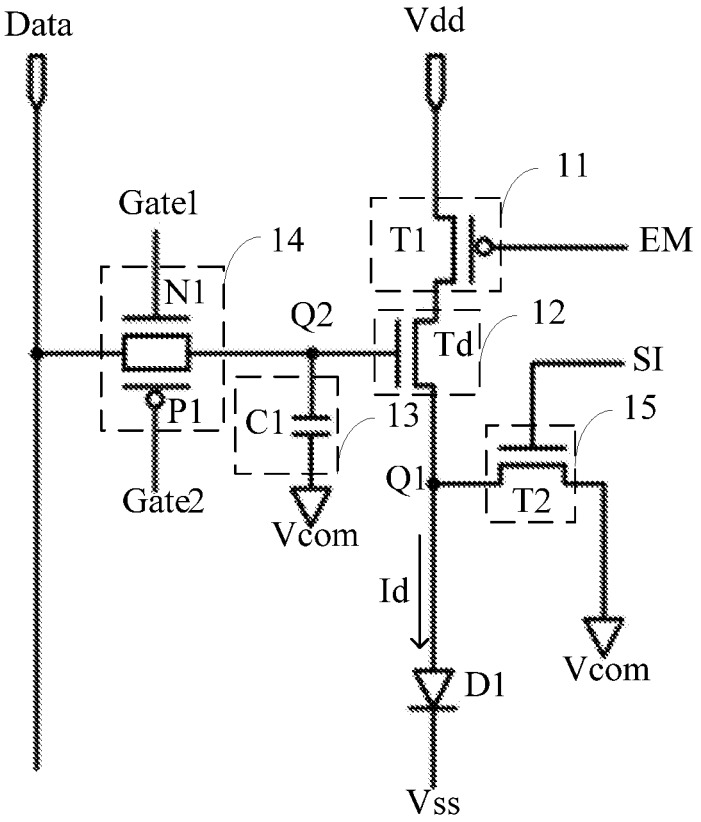
FIG. 2 is a structural diagram of a pixel circuit in accordance with an embodiment of the present disclosure.

FIG. 2 is a structural diagram of a pixel circuit in accordance with an embodiment of the present disclosure. As illustrated in FIG. 2, the pixel circuit receives four gate signals through four gate lines, namely a first gate driving signal Gate1, a second gate driving signal Gate2 (the first and second gate driving signals are collectively referred to as gate driving signals), a light-emitting control signal EM, and an initializing signal SI (all taking a gate signal reference voltage as a reference zero). The pixel circuit in this embodiment receives a data voltage through a data signal end Data connected to a data line and includes a switching control sub-circuit 11, a driving sub-circuit 12, a storage sub-circuit 13, and a data writing sub-circuit 14. The entire pixel circuit is configured to, when the received gate driving signal is at an effective level, refresh a stored data voltage based on a voltage at the data signal end Data, and is also configured to, when the received light-emitting control signal EM is at an effective level, output light-emitting current Id based on the stored data voltage. The value of the light-emitting current Id is in positive correlation with that of the data voltage. Specifically, the pixel circuit further includes a light-emitting power end Vdd and a current output end Q1, and is configured to output the light-emitting current Id to the current output end Q1 under power supply through the light-emitting power end Vdd. That is, the pixel circuit is configured to, when the received light-emitting control signal EM is at an effective level, output the light-emitting current Id to the current output end Q1 based on the stored data voltage under power supply through the light-emitting power end Vdd. In addition, the current output end Q1 is connected to an anode of a light-emitting device D1, and a cathode of the light-emitting device D1 is connected to a light-emitting power common end Vss, such that the light-emitting device D1 can receive the light-emitting current Id output by the pixel circuit to emit light at a brightness corresponding to the value of the light-emitting current Id. Exemplarily, the light-emitting device D1 may be an OLED or a quantum-dot light-emitting diode (QLED).

It should be noted: it is merely an example that the pixel circuit is connected to the light-emitting power end Vdd, and configured to provide the light-emitting current from the anode of the light-emitting device. Exemplarily, the above-mentioned light-emitting power end Vdd may be replaced with the light-emitting power common end Vss, such that the pixel circuit is configured to supply the light-emitting current through the cathode of the light-emitting device. At this time, the anode of the light-emitting device is directly connected to the light-emitting power end Vdd, and the cathode of the light-emitting device is connected to the pixel circuit. From an anode of a power supply, an output path of the light-emitting current Id sequentially passes through the anode of the light-emitting device, the cathode of the light-emitting device, and the pixel circuit, to a cathode of the power supply.

Referring to FIG. 2, in the present embodiment, the pixel circuit includes:

a switching control sub-circuit 11, connected to a gate line that provides a light-emitting control signal EM, and configured to conduct the output path of the light-emitting current Id when the received light-emitting control signal EM is at an effective level;

a driving sub-circuit 12, disposed in the output path of the light-emitting current Id and configured to adjust the value of the light-emitting current Id based on a voltage at a control end Q1, such that the value of the light-emitting current Id is in positive correlation with that of the voltage at the control end Q1;

a storage sub-circuit 13, connected to a control end Q2 of the driving sub-circuit 12 and configured to store the data voltage and to provide the stored data voltage to the control end Q2 of the driving sub-circuit 12;

a data writing sub-circuit 14, connected to a gate line that provides the gate driving signal and configured to, based on a voltage at the data signal end Data when the received gate driving signal is at an effective level, refresh the data voltage stored in the storage sub-circuit 13; and an initializing sub-circuit 15, connected to a gate line that provides the initializing signal SI and configured to set a voltage at a current output end Q1 as an initializing voltage when a received initializing signal SI is at an effective level.

As an example, in FIG. 2, the switching control sub-circuit 11 includes a first transistor T1, a gate of the first transistor is connected to the gate line that provides the light-emitting control signal EM and a source and a drain of the first transistor are respectively connected to one of the light-emitting power end Vdd and the driving sub-circuit 12. Exemplarily, the first transistor T1 may be a P-type transistor. A period in which the received light-emitting control signal EM as mentioned above is at an effective level is a period in which the light-emitting control signal EM is at a low level, the first transistor T1 is turned on in this period to conduct the output channel of the light-emitting current Id, and is turned off out of this period to cut off the output channel of the light-emitting current Id so as to achieve the function of the switching control sub-circuit 11. It should be noted that respective connection relationships of the source and the drain of the transistor may be set based on the specific type of the transistor to match a direction in which current flows through the transistor. The source and the drain can be regarded as two electrodes that are not distinctive from each other when the transistor adopts a structure in which the source and the drain are symmetric with each other. Therefore, one of the source and the drain of the transistor may be called a first electrode, and the other may be called a second electrode.

As an example, in FIG. 2, the driving sub-circuit 12 includes a driving transistor Td, and the storage sub-circuit 13 includes a first capacitor C1. A gate of the driving transistor Td is connected to the data writing sub-circuit 14 and the storage sub-circuit 13 and a source and a drain of the driving transistor Td are respectively connected to one of the switching control sub-circuit 11 and the current output end Q1. A first end of the first capacitor C1 is connected to the data writing sub-circuit 14 and the control end Q2 of the driving sub-circuit 12 and a second end of the first capacitor C1 is connected to a common voltage line Vcom. Exemplarily, the driving transistor Td may be an N-type transistor, such that the data voltage stored in the first capacitor C1 (namely, the gate voltage of the driving transistor Td) can control the value of source/drain current of the driving transistor Td. The higher the data voltage is, the larger the value of the source/drain current of the driving transistor Td is. Thus, the functions of the driving sub-circuit 12 and the storage sub-circuit 13 are achieved. It should be noted that even if the driving sub-circuit 12 is implemented by a P-type transistor, the value of the light-emitting current Id can still be in positive correlation with that of the voltage at the control end Q2.

As an example, the first gate driving signal Gate1 and the second gate driving signal Gate2 may be a normal-phase gate driving signal and a reversed-phase gate driving signal respectively. The data writing sub-circuit 14 may include a first N-type transistor N1 and a first P-type transistor P1. A gate of the first N-type transistor N1 is connected to a gate line that provides the first gate driving signal Gate1, and a source and a drain of the first N-type transistor N1 are connected to one of the data signal end Data and the storage sub-circuit 13. A gate of the first P-type transistor P1 is connected to a gate line that provides the second gate driving signal Gate2, and a source and a drain of the first P-type transistor P1 are respectively connected to one of the data signal end Data and the storage sub-circuit 13. In this way, a period in which the received gate driving signal is an effective level is a period in which the first gate driving signal Gate 1 is at a high level and the second gate driving signal Gate2 is at a low level. The first N-type transistor N1 and the first P-type transistor P1 are both turned on in this period, such that the voltage at the data signal end Data may be written into a current source module to refresh the data voltage stored in the storage sub-circuit 13. The first N-type transistor N1 and the first P-type transistor P1 are turned off out of this period, such that the voltage at the data signal end Data and the data voltage stored in the storage sub-circuit 13 may not affect each other. Therefore, the function of the data writing sub-circuit 14 is achieved. In addition, the first N-type transistor N1 and the first P-type transistor P1 can be configured to conduct a high voltage and a low voltage respectively, and thus are more advantageous to expand the range of the written voltage with respect to a single transistor.

As an example, the initializing sub-circuit 15 may set the voltage at the current output end Q1 as an initializing voltage before each refreshing of the data voltage, thereby helping to reduce mutual influence of the data voltages of a previous and a subsequent frame and to solve a problem of motion blur under high frequency driving. In FIG. 2, the initializing sub-circuit 15 includes a second transistor T2, a gate of which is connected to the gate line that provides the initializing signal SI and a source and a drain of which are respectively connected to one of the current output end Q1 and the common voltage line Vcom. Exemplarily, the second transistor T2 may be an N-type transistor. A period in which the initializing signal SI is at a high level may be set before a period in which each received gate driving signal is at an effective level, such that the second transistor T2 may set a voltage at a node Q1 as a common voltage before each refreshing of the data voltage stored in the storage sub-circuit 13 so as to achieve the function of the initializing sub-circuit 15 described above. Alternatively, in addition to the common voltage, the initializing voltage may further be, for instance, a gate low level (VGL) or a light-emitting power low voltage (ELVSS), which can be configured according to application requirements.

Figure 3:
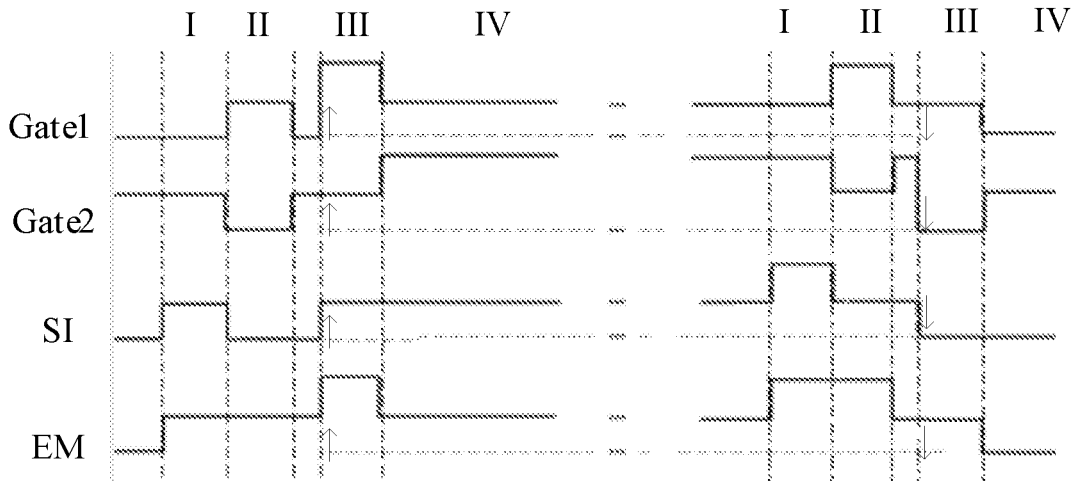
FIG. 3 is a sequence diagram of a pixel circuit in accordance with an embodiment of the present disclosure.

FIG. 3 is a sequence diagram of a pixel circuit in accordance with an embodiment of the present disclosure. Referring to FIG. 3, which shows two working cycles of the pixel circuit, each working cycle of the pixel circuit includes an initializing phase I, a first data writing phase II, a second data writing phase III, and a light-emitting phase VI. For the convenience of description, in this example, the first voltage range is (1 V, 5 V], the second voltage range is (5 V, 9 V), and the demarcation value is 5 V; in the first working cycle, the current data voltage is 2 V, and the target data voltage is 8 V; and in the second working cycle, the current data voltage is 8 V, and the target data voltage is 3 V. Refer to FIGS. 2 and 3 for the first working cycle as below.

In the initializing phase I, the gate line that provides the second gate driving signal Gate2, the gate line that provides the light-emitting control signal EM, and the gate line that provides the initializing signal SI are all at high levels, and the gate line that provides the first gate driving signal Gate1 is at a low level, such that the second transistor T2 is turned on, and the first N-type transistor N1, the first P-type transistor P1 and the first transistor T1 are turned off. At this time, the common voltage on the common voltage line Vcom will be written to the current output end Q1, and the anode of the light-emitting device D1 is set to the common voltage by the second transistor T2, thereby completing initialization of the pixel circuit. In this phase, the voltage at the control end Q2 will be maintained as the data voltage previously stored in the first capacitor C1, such that the driving transistor Td may be turned on. However, since the turned-off first transistor T1 cuts off the output path of the light-emitting current, there may be no current passing through the light-emitting device D1, and the light-emitting device D1 may be in a non-luminance status, for example, a reversed bias status.

In the first data writing phase II, the gate line that provides the first gate driving signal Gate1 and the gate line that provides the light-emitting control signal EM are both at high levels, and the gate line that provides the second gate driving signal Gate2 and the gate line that provides the initializing signal SI are both at low levels, such that the first N-type transistor N1 and the first P-type transistor P1 are turned on, and the first transistor T1 and the second transistor T2 are turned off. At this time, the voltage at the data signal end Data is the demarcation value 5V between the first voltage range and the second voltage range, such that the first capacitor C1 will be charged or discharged till the voltage at the node Q2 is approximately equal to the demarcation value 5V. That is, the stored data voltage with the current data voltage is refreshed with the demarcation value. It can be foreseen that after the first N-type transistor N1 and the first P-type transistor P1 are turned off, the first capacitor C1 can keep the voltage at the node Q2 unchanged. That is, the data voltage is stored. In this phase, the first transistor T1 is still off, and thus the light-emitting device D1 not supplied with the light-emitting current is still in a non-luminous status.

The second data writing phase III: At the beginning of the second data writing phase III, the gate signal reference voltage changes in the direction and by the amplitude indicated by the arrow. That is, reference voltages of the four gate lines are simultaneously increased by the same amplitude, making potentials of their high-level and low-level potentials changed. The changed low-level potential is the same as the previous high-level potential, and the changed high-level potential is higher than the previous high-level potential. Based on the changed reference potential, the gate line that provides the first gate driving signal Gate1 and the gate line that provides the light-emitting control signal EM are both at high levels, and the gate line that provides the second gate driving signal Gate2 and the gate line that provides the initializing signal SI are both at low levels. It can be seen that the high-level and low-level statuses of the respective gate lines in the second data writing phase III are actually the same as those in the first data writing phase II, but their actual potentials in FIG. 3 are increased by the same amplitude as the gate signal reference voltage rises. Therefore, the first N-type transistor N1 and the first P-type transistor P1 are turned on, and the first transistor T1 and the second transistor T2 are turned off, such that the voltage at the node Q2 will change from 5 V in the first data writing stage II to the voltage of 8 V at the data signal end Data. That is, the stored data voltage with the demarcation value is refreshed with the target data voltage. In this phase, the first transistor T1 is still off, and thus the light-emitting device D1 not supplied with the light-emitting current is still in a non-luminous status.

In the light-emitting phase VI, the gate line that provides the second gate driving signal Gate2 is at a high level, and the gate line that provides the first gate driving signal Gate1, the gate line that provides the light-emitting control signal EM, and the gate line that provides the initializing signal SI are all at low levels, such that the first N-type transistor N1, the first P-type transistor P1 and the second transistor T2 are turned off, the first transistor T1 and the driving transistor Td are both turned on, and the output path of the light-emitting current is conducted. Based on characteristics of the driving transistor Td, the value of the light-emitting current is determined by the data voltage 8 V stored at the node Q2. In this way, the light-emitting device D1 can emit light at a corresponding brightness based on the data voltage 8 V stored in the pixel circuit till the current working cycle of the pixel circuit ends.

After the first working cycle ends, refer to FIGS. 2 and 3 for the second working cycle as below.

In the initializing phase I, based on the gate signal reference voltage that changes in the first working cycle, the gate line that provides the second gate driving signal Gate2, the gate line that provides the light-emitting control signal EM, and the gate line that provides the initializing signal SI are all at high levels, and the gate line that provides the first gate driving signal Gate1 is at a low level, such that the second transistor T2 is turned on, the first N-type transistor N1, the first P-type transistor P1 and the first transistor T1 are turned off. At this time, the common voltage on the common voltage line Vcom will be written to the current output end Q1, and the anode of the light emitting device D1 is set to the common voltage by the second transistor T2, thereby completing initialization of the pixel circuit. In this phase, the voltage at the control end Q2 will be maintained as the data voltage previously stored in the first capacitor C1, such that the driving transistor Td may be turned on. However, since the turned-off first transistor T1 cuts off the output path of the light-emitting current, there may be no current passing through the light-emitting device D1, and the light-emitting device D1 may be in a non-luminance status, for example, a reversed bias status.

In the first data writing phase II, the gate line that provides the first gate driving signal Gate1 and the gate line that provides the light-emitting control signal EM are both at high levels, and the gate line that provides the second gate driving signal Gate2 and the gate line that provides the initializing signal SI are both at low levels, such that the first N-type transistor N1 and the first P-type transistor P1 are turned on, and the first transistor T1 and the second transistor T2 are turned off. At this time, the voltage at the data signal end Data is the demarcation value 5V of the first voltage range and the second voltage range, such that the first capacitor C1 will be charged or discharged till the voltage at the node Q2 is approximately equal to the demarcation value 5V. That is, the stored data voltage with the current data voltage is refreshed with the demarcation value. It can be foreseen that after the first N-type transistor N1 and the first P-type transistor P1 are turned off, the first capacitor C1 can keep the voltage at the node Q2 unchanged. That is, the data voltage is stored. In this phase, the first transistor T1 is still off, and thus the light-emitting device D1 not supplied with the light-emitting current is still in a non-luminous status.

The second data writing phase III: At the beginning of the second data writing phase III, the gate signal reference voltage changes in the direction and by the amplitude indicated by the arrow. That is, reference voltages of the four gate lines are simultaneously reduced by the same amplitude, making their high-level and low-level potentials back to the status before the first working cycle. Based on the changed reference potential, the gate line that provides the first gate driving signal Gate1 and the gate line that provides the light-emitting control signal EM are both at high levels, the gate line that provides the second gate driving signal Gate2 and the gate line that provides the initializing signal SI are both at low levels. It can be seen that the high-level and low-level statuses of the gate lines in the second data writing phase III are actually the same as those in the first data writing phase II, but their actual potentials in FIG. 3 are reduced by the same amplitude as the gate signal reference voltage decreases. Therefore, the first N-type transistor N1 and the first P-type transistor P1 are turned on, and the first transistor T1 and the second transistor T2 are turned off, such that the voltage at the node Q2 is changed from 5 V in the first data writing stage II to the voltage of 3 V at the data signal end Data. That is, the stored data voltage with the demarcation value is refreshed with the target data voltage. In this phase, the first transistor T1 is still off, and the light-emitting device D1 not supplied with the light-emitting current is still in a non-luminous status.

The light-emitting phase VI: the gate line that provides the second gate driving signal Gate2 is at a high level, the gate line that provides the first gate driving signal Gate1, the gate line that provides the light-emitting control signal EM, and the gate line that provides the initializing signal SI are all at low levels, such that the first N-type transistor N1, the first P-type transistor P1 and the second transistor T2 are turned off, the first transistor T1 and the driving transistor Td are turned on, and the output path of the light-emitting current is conducted. Based on characteristics of the driving transistor Td, the value of the light-emitting current is determined by the data voltage 3 V stored at the node Q2. In this way, the light-emitting device D1 can emit light at a corresponding brightness based on the data voltage 3 V stored in the pixel circuit till the current working cycle of the pixel circuit ends.

Taking working processes of the pixel circuit in the first and second working cycles as an example, in a possible implementation mode, the above step 101 may particularly include: providing the gate line with a gate signal based on a first voltage, and providing the data line with a voltage of which the value is the demarcation value, such that the data voltage stored in the pixel circuit is refreshed with the demarcation value. The above step 102 may particularly include: providing the gate line with a gate signal based on a second voltage, and providing the data line with the target data voltage, such that the data voltage stored in the pixel circuit is refreshed with the target data voltage. The first voltage is a gate signal reference voltage corresponding to the first voltage range, and the second voltage is a gate signal reference voltage corresponding to the second voltage range. In this way, the method can be implemented by controlling signals on the gate line and the data line outside a display area.

It can be seen that, with respect to the related art in which the light-emitting device D1 can only emit light at a brightness corresponding to a data voltage within the range of (1 V, 5 V] or (5 V, 9 V), the embodiment of the present disclosure obviously can help to achieve higher brightness and/or contrast. It should be understood that at least two voltage ranges in other forms and a gate signal reference voltage corresponding to each voltage range can be set with reference to the example to achieve required higher display brightness and/or display contrast based on application requirements.

It should be noted that in the foregoing first second data writing phase III and the second initialization phase I, a voltage difference between the control end Q2 and the current output end Q1 may exceed 6 V. However, since the first transistor T1 is turned off, and the driving transistor Td actually does not work, the driving transistor Td may not be damaged. In the aforementioned first light-emitting phase VI, since the first transistor T1 is turned on, the voltage difference between the control end Q2 and the current output end Q1 instantaneously changes to be within 6 V. Thus, its influence may be ignored.

Figure 4:
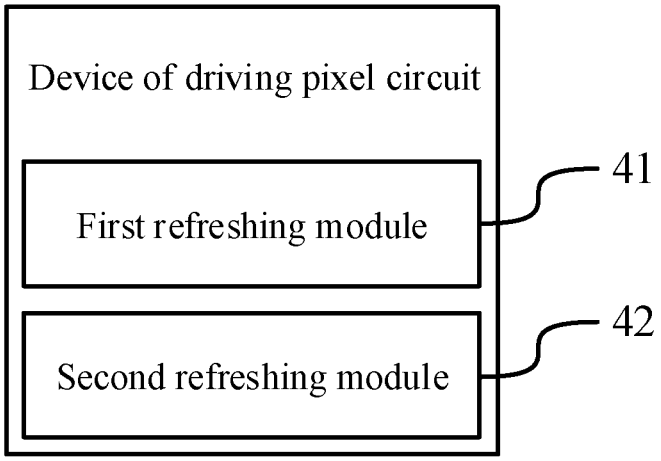
FIG. 4 is a structural block diagram of a device of driving a pixel circuit in accordance with an embodiment of the present disclosure.

Based on the same inventive concept, FIG. 4 is a structural block diagram of a device of driving a pixel circuit in accordance with an embodiment of the present disclosure. The pixel circuit is configured to refresh a stored data voltage under control of a gate signal. Referring to FIG. 4, the device includes:

a first refreshing module 41, configured to, when a current data voltage of the pixel circuit is within a first voltage range and a target data voltage of the pixel circuit is within a second voltage range, refresh the data voltage stored in the pixel circuit with a demarcation value between the first voltage range and the second voltage range through a first gate signal reference voltage corresponding to the first voltage range; and a second refreshing module 42, configured to, after the data voltage stored in the pixel circuit is refreshed with the demarcation value, refresh the data voltage stored in the pixel circuit with the target data voltage through a second gate signal reference voltage corresponding to the second voltage range.

The target data voltage and the current data voltage are data voltages after and before the refreshing in a refreshing process respectively. The first voltage range and the second voltage range respectively take the demarcation value as one of a maximum endpoint and a minimum endpoint. The first gate signal reference voltage is lower than the second gate signal reference voltage if the target data voltage is higher than the current data voltage. The first gate signal reference voltage is higher than the second gate signal reference voltage if the target data voltage is lower than the current data voltage. The first gate signal reference voltage and the second gate signal reference voltage are measurement criteria of a level status of the gate signal.

It should be understood that based on the driving process described above, the device may implement the above-mentioned method of driving the pixel circuit based on a structure corresponding to the driving process, and thus, its specific details will not be repeated.

Based on the same inventive concept, yet another embodiment of the present disclosure provides a device of driving a pixel circuit. The pixel circuit is configured to refresh a stored data voltage under control of a gate signal. In this embodiment, the device includes:

a processor; and a memory configured to store an instruction executable by the processor.

The processor is configured to:

when a current data voltage of the pixel circuit is within a first voltage range and a target data voltage of the pixel circuit is within a second voltage range, refresh the data voltage stored in the pixel circuit with a demarcation value between the first voltage range and the second voltage range through a first gate signal reference voltage corresponding to the first voltage range; and after the data voltage stored in the pixel circuit is refreshed with the demarcation value, refresh the data voltage stored in the pixel circuit with the target data voltage through a second gate signal reference voltage corresponding to the second voltage range.

The target data voltage and the current data voltage are data voltages after and before the refreshing in a refreshing process respectively. The first voltage range and the second voltage range respectively take the demarcation value as one of a maximum endpoint and a minimum endpoint. The first gate signal reference voltage is lower than the second gate signal reference voltage if the target data voltage is higher than the current data voltage. The first gate signal reference voltage is higher than the second gate signal reference voltage if the target data voltage is lower than the current data voltage. The first gate signal reference voltage and the second gate signal reference voltage are measurement criteria of a level status of the gate signal.

It should be understood that the processor may include a general-purpose central processing unit (CPU), a microprocessor, an application-specific integrated circuit (ASIC), a digital signal processor (DSP), a digital signal processing device (DSPD), programmable logic device (PLD), field programmable gate array (FPGA), controller, microcontroller, or multiple integrated circuits for controlling program execution. The memory may include a Read-Only Memory (ROM) or other types of static storage devices that can store static information and instructions, a Random-Access Memory (RAM) or other types of dynamic storage devices that can store information and instructions. It may also include an Electrically Erasable Programmable Read-Only Memory (EEPROM), a Compact Disc Read-Only Memory (CD-ROM) or other optical disk storage, optical disk storage (including compressed optical discs, laser discs, optical discs, digital universal discs, Blue-ray discs, etc.), magnetic disk storage medium or other magnetic storage devices, or any other media that can be used to carry or store desired program codes in the form of instructions or data structures and can be stored and accessed by a computer, but is not limited thereto. The memory can be arranged independently or integrated with a processor.

In one example, the above memory may include executable instructions corresponding to any of the above pixel circuit driving methods such that the driving device can realize any of the above pixel circuit driving methods through executing these instructions by the processor. The details will not be elaborated herein.

Figure 5:
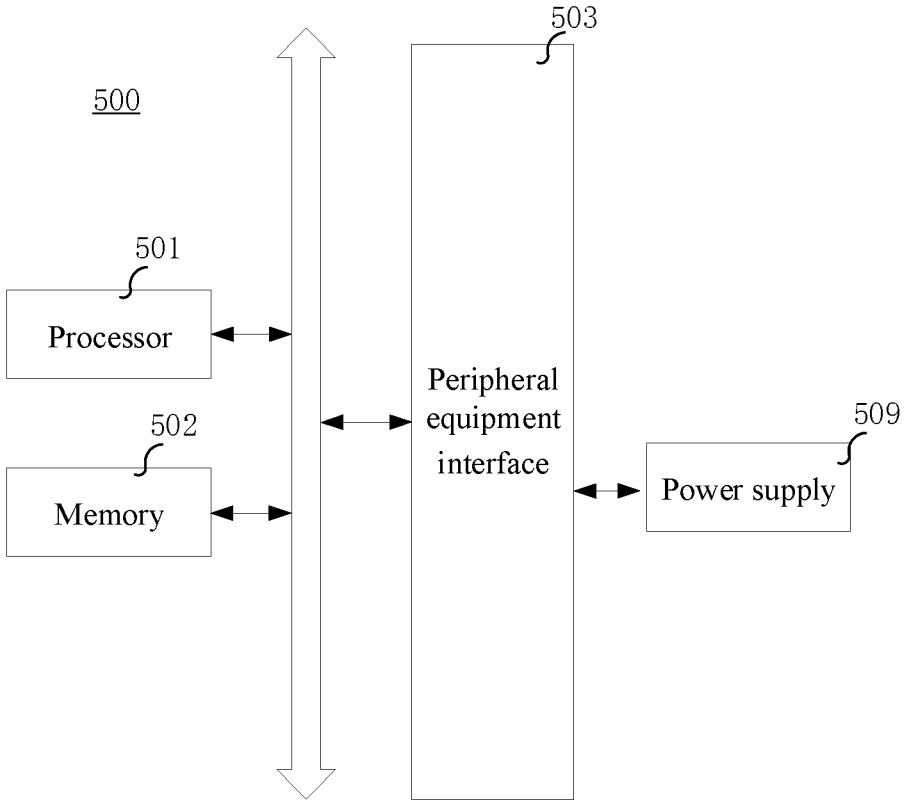
FIG. 5 is a structural block diagram of a device of driving a pixel circuit in accordance with an embodiment of the present disclosure.

FIG. 5 is a structural block diagram of a pixel circuit driving device 500 in accordance with one embodiment of the present disclosure. Generally, the device 500 includes a processor 501 and a memory 502.

The processor 501 may include one or more processing cores, such as a 4-core processor and an 8-core processor. The processor 501 may be achieved by at least one hardware of a DSP (Digital Signal Processing), an FPGA (Field-Programmable Gate Array), and a PLA (Programmable Logic Array). The processor 501 may also include a main processor and a coprocessor. The main processor is a processor for processing the data in an awake state, and is also called a CPU (Central Processing Unit). The coprocessor is a low-power-consumption processor for processing the data in a standby state. In some embodiments, the processor 501 may be integrated with a GPU (Graphics Processing Unit), which is configured to render and draw content that needs to be displayed on a display screen. In some embodiments, the processor 501 may further include an AI (Artificial Intelligence) processor configured to process computational operations related to machine learning.

The memory 502 may include one or more computer-readable storage mediums, which can be non-transitory. The memory 502 may further include a high-speed random-access memory, as well as a non-volatile memory, such as one or more disk storage devices and flash storage devices. In some embodiments, the non-transitory computer-readable storage medium in the memory 502 is configured to store at least one instruction. The at least one instruction is configured to be executed by the processor 501 to implement the backlight driving method provided by the method embodiments of the present disclosure.

In some embodiments, the device 500 can further optionally includes a peripheral device interface 503 and at least one peripheral device. The processor 501, the memory 502, and the peripheral device interface 503 may be connected by a bus or a signal line. Each peripheral device may be connected to the peripheral device interface 503 through a bus, a signal line or a circuit board. For example, the peripheral device may include a power source 509 for supplying power to the respective components of the device 500.

It will be understood by those skilled in the art that the structure illustrated in FIG. 5 does not constitute a limitation to the device 500, and may include more or less components than those illustrated, or combine some components or adopt different component arrangements.

In exemplary embodiments, a non-transitory computer-readable storage medium including instructions is also provided, such as the memory including instructions, executable by the processor in the device, for performing the above-described methods. For example, the non-transitory computer-readable storage medium may be a ROM, a RAM, a CD-ROM, a magnetic tape, a floppy disc, an optical data storage device, and the like.

The foregoing descriptions are merely optional embodiments of the present disclosure, and are not intended to limit the present disclosure. Within the spirit and principles of the disclosure, any modifications, equivalent substitutions, improvements, etc., are within the protection scope of the present disclosure.

What is claimed is:

1. A method of driving a pixel circuit, wherein the pixel circuit is configured to refresh a data voltage stored in the pixel circuit under control of a gate signal; and when a current data voltage of the pixel circuit is within a first voltage range and a target data voltage of the pixel circuit is within a second voltage range, the method comprises:

refreshing the data voltage stored in the pixel circuit with a demarcation value between the first voltage range and the second voltage range through a first gate signal reference voltage corresponding to the first voltage range; and refreshing the data voltage stored in the pixel circuit with the target data voltage through a second gate signal reference voltage corresponding to the second voltage range, wherein the target data voltage and the current data voltage are data voltages after and before the refreshing in a refreshing process respectively; the first voltage range and the second voltage range respectively take the demarcation value as one of a maximum endpoint and a minimum endpoint; the first gate signal reference voltage is lower than the second gate signal reference voltage when the target data voltage is higher than the current data voltage; the first gate signal reference voltage is higher than the second gate signal reference voltage when the target data voltage is lower than the current data voltage; and the first gate signal reference voltage and the second gate signal reference voltage are measurement criteria of a level status of the gate signal.

2. The method according to claim 1, wherein the pixel circuit receives the gate signal by a gate line and receives the data voltage by a data line;

refreshing the data voltage stored in the pixel circuit with the demarcation value between the first voltage range and the second voltage range through the first gate signal reference voltage corresponding to the first voltage range comprises:

providing the gate line with a gate signal based on the first gate signal reference voltage, and providing the data line with a voltage of which a value is the demarcation value, such that the data voltage stored in the pixel circuit is refreshed with the demarcation value; and refreshing the data voltage stored in the pixel circuit with the target data voltage through the second gate signal reference voltage corresponding to the second voltage range comprises:

providing the gate line with a gate signal based on the second gate signal reference voltage, and providing the data line with the target data voltage, such that the data voltage stored in the pixel circuit is refreshed with the target data voltage.

3. The method according to claim 1, wherein a difference between a maximum endpoint and a minimum endpoint of the first voltage range equals that between a maximum endpoint and a minimum endpoint of the second voltage range, and an absolute value of a difference between the first gate signal reference voltage and the second gate signal reference voltage equals the difference between the maximum endpoint and the minimum endpoint of the first voltage range.

4. The method according to claim 1, wherein the gate signal comprises a light-emitting control signal and a gate driving signal;

the pixel circuit comprises a data signal end and is configured to, when the received gate driving signal is at an effective level, refresh the data voltage stored in the pixel circuit based on a voltage at the data signal end; and the pixel circuit further comprises a light-emitting power end and a current output end and is further configured to, when the received light-emitting control signal is at an effective level, output light-emitting current to the current output end based on the data voltage stored in the pixel circuit under power supply by the light-emitting power end, and a value of the light-emitting current is in a positive correlation with a value of the data voltage.

5. The method according to claim 4, wherein the pixel circuit comprises:

a switching control sub-circuit configured to conduct an output path of the light-emitting current when the received light-emitting control signal is at an effective level;

a driving sub-circuit configured to adjust the value of the light-emitting current based on a voltage at a control end, such that the value of the light-emitting current is in a positive correlation with the value of the voltage at the control end;

a storage sub-circuit configured to store the data voltage and to provide the data voltage to the control end of the driving sub-circuit; and a data writing sub-circuit configured to, when the received gate driving signal is at an effective level, refresh the data voltage stored in the storage sub-circuit based on the voltage at the data signal end.

6. The method according to claim 5, wherein the gate driving signal comprises a first gate driving signal and a second gate driving signal, and the data writing sub-circuit comprises a first N-type transistor and a first P-type transistor;

a gate of the first N-type transistor is connected to a signal line that provides the first gate driving signal, and a first electrode and a second electrode of the first N-type transistor are respectively connected to one of the data signal end and the storage sub-circuit; and a gate of the first P-type transistor is connected to a signal line that provides the second gate driving signal, and a first electrode and a second electrode of the first P-type transistor are respectively connected to one of the data signal end and the storage sub-circuit.

7. The method according to claim 5, wherein the storage sub-circuit comprises a first capacitor, wherein a first end of the first capacitor is connected to an output end of the data writing sub-circuit and a second end of the first capacitor is connected to a common voltage line;

the switching control sub-circuit comprises a first transistor, wherein a gate of the first transistor is connected to a signal line that provides the light-emitting control signal and a first electrode of the first transistor is connected to the light-emitting power end; and the driving sub-circuit comprises a driving transistor, wherein a gate of the driving transistor is connected to the first end of the first capacitor, a first electrode of the driving transistor is connected to a second electrode of the first transistor and a second electrode of the driving transistor is connected to the current output end.

8. The method according to claim 5, wherein the pixel circuit further comprises an initializing sub-circuit, wherein the initializing sub-circuit is configured to set an initializing voltage as a voltage at a current output end when a received initializing signal is at an effective level.

9. The method according to claim 8, wherein the initializing sub-circuit comprises a second transistor, wherein a gate of the second transistor is connected to a signal line that provides the initializing signal and a first electrode of the second transistor and a second electrode of the second transistor are respectively connected to one of the current output end and a common voltage line.

10. A non-transitory computer-readable storage medium, wherein, when an instruction in the computer-readable storage medium is executed by a processor of a computer, the computer is caused to perform the method as according to claim 1.

11. A device of driving a pixel circuit, wherein the pixel circuit is configured to refresh a data voltage stored in the pixel circuit under control of a gate signal, and the device comprises:

a processor; and a memory configured to store an instruction executable by the processor, wherein the processor is configured to implement a method comprising:

when a current data voltage of the pixel circuit is within a first voltage range and a target data voltage of the pixel circuit is within a second voltage range, refreshing the data voltage stored in the pixel circuit with a demarcation value between the first voltage range and the second voltage range through a first gate signal reference voltage corresponding to the first voltage range; and after the data voltage stored in the pixel circuit is refreshed with the demarcation value, refreshing the data voltage stored in the pixel circuit with the target data voltage through a second gate signal reference voltage corresponding to the second voltage range, wherein the target data voltage and the current data voltage are data voltages after and before the refreshing in a refreshing process respectively; the first voltage range and the second voltage range respectively take the demarcation value as one of a maximum endpoint and a minimum endpoint; the first gate signal reference voltage is lower than the second gate signal reference voltage when the target data voltage is higher than the current data voltage; the first gate signal reference voltage is higher than the second gate signal reference voltage when the target data voltage is lower than the current data voltage; and the first gate signal reference voltage and the second gate signal reference voltage are measurement criteria of a level status of the gate signal.

12. The device according to claim 11, wherein the pixel circuit receives the gate signal by a gate line and receives the data voltage by a data line;

refreshing the data voltage stored in the pixel circuit with the demarcation value between the first voltage range and the second voltage range through the first gate signal reference voltage corresponding to the first voltage range comprises:

providing the gate line with a gate signal based on the first gate signal reference voltage, and providing the data line with a voltage of which a value is the demarcation value, such that the data voltage stored in the pixel circuit is refreshed with the demarcation value; and refreshing the data voltage stored in the pixel circuit with the target data voltage through the second gate signal reference voltage corresponding to the second voltage range comprises:

providing the gate line with a gate signal based on the second gate signal reference voltage, and providing the data line with the target data voltage, such that the data voltage stored in the pixel circuit is refreshed with the target data voltage.

13. The device according to claim 11, wherein a difference between a maximum endpoint and a minimum endpoint of the first voltage range equals that between a maximum endpoint and a minimum endpoint of the second voltage range, and an absolute value of a difference between the first gate signal reference voltage and the second gate signal reference voltage equals the difference between the maximum endpoint and the minimum endpoint of the first voltage range.

14. The device according to claim 11, wherein the gate signal comprises a light-emitting control signal and a gate driving signal;

the pixel circuit comprises a data signal end and is configured to, when the received gate driving signal is at an effective level, refresh the data voltage stored in the pixel circuit based on a voltage at the data signal end; and the pixel circuit further comprises a light-emitting power end and a current output end and is further configured to, when the received light-emitting control signal is at an effective level, output light-emitting current to the current output end based on the data voltage stored in the pixel circuit under power supply by the light-emitting power end, and a value of the light-emitting current is in a positive correlation with a value of the data voltage.

15. The device according to claim 14, wherein the pixel circuit comprises:

a switching control sub-circuit configured to conduct an output path of the light-emitting current when the received light-emitting control signal is at an effective level;

a driving sub-circuit configured to adjust the value of the light-emitting current based on a voltage at a control end, such that the value of the light-emitting current is in a positive correlation with the value of the voltage at the control end;

a storage sub-circuit configured to store the data voltage and to provide the data voltage to the control end of the driving sub-circuit; and a data writing sub-circuit configured to, when the received gate driving signal is at an effective level, refresh the data voltage stored in the storage sub-circuit based on the voltage at the data signal end.

16. The device according to claim 15, wherein the gate driving signal comprises a first gate driving signal and a second gate driving signal, and the data writing sub-circuit comprises a first N-type transistor and a first P-type transistor;

a gate of the first N-type transistor is connected to a signal line that provides the first gate driving signal, and a first electrode and a second electrode of the first N-type transistor are respectively connected to one of the data signal end and the storage sub-circuit; and a gate of the first P-type transistor is connected to a signal line that provides the second gate driving signal, and a first electrode and a second electrode of the first P-type transistor are respectively connected to one of the data signal end and the storage sub-circuit.

17. The device according to claim 15, wherein the storage sub-circuit comprises a first capacitor, wherein a first end of the first capacitor is connected to an output end of the data writing sub-circuit and a second end of the first capacitor is connected to a common voltage line;

the switching control sub-circuit comprises a first transistor, wherein a gate of the first transistor is connected to a signal line that provides the light-emitting control signal and a first electrode of the first transistor is connected to the light-emitting power end; and the driving sub-circuit comprises a driving transistor, wherein a gate of the driving transistor is connected to the first end of the first capacitor, a first electrode of the driving transistor is connected to a second electrode of the first transistor and a second electrode of the driving transistor is connected to the current output end.

18. The device according to claim 15, wherein the pixel circuit further comprises an initializing sub-circuit, wherein the initializing sub-circuit is configured to set an initializing voltage as a voltage at a current output end when a received initializing signal is at an effective level.

19. The device according to claim 18, wherein the initializing sub-circuit comprises a second transistor, wherein a gate of the second transistor is connected to a signal line that provides the initializing signal and a first electrode of the second transistor and a second electrode of the second transistor are respectively connected to one of the current output end and a common voltage line.

* * * * *